United States Patent [19]

Ishizuka

[11] Patent Number: 4,647,355

[45] Date of Patent: Mar. 3, 1987

[54] APPARATUS FOR MOLTEN SALT ELECTROLYSIS

[76] Inventor: Hiroshi Ishizuka, 19-2, Ebara 6-chome, Shinagawa-ku, Tokyo, Japan

[21] Appl. No.: 791,558

[22] Filed: Oct. 25, 1985

[30] Foreign Application Priority Data

Nov. 9, 1984 [JP] Japan ..... 59-236988

[51] Int. Cl.[4] ..... C25C 3/00; C25C 7/00

[52] U.S. Cl. ..... 204/243 R; 204/274

[58] Field of Search ..... 204/243 R–247, 204/274, 241

[56] References Cited

U.S. PATENT DOCUMENTS 1,855,351 4/1932 Hunter ..... 204/243 R 3,507,768 4/1970 Adaev et al. ..... 204/274

4,222,841 9/1980 Miller ..... 204/274 X

*Primary Examiner*—Donald R. Valentine

*Attorney, Agent, or Firm*—Larson and Taylor

[57] ABSTRACT

An apparatus for molten salt electrolysis, comprising: an electrolysis chamber which is capable of holding a molten salt of metallic chloride and is closed upwards with a top cover, a cathode placed in said chamber, a lead block of metallic material which runs through the top cover and comprises therealong a bottom-closed axial cavity with inlet and outlet for a fluid coolant connected thereto, said cathode and lead block connected to each other below the bath level to be employed of said salt, and said cavity reaching below said level.

5 Claims, 4 Drawing Figures

APPARATUS FOR MOLTEN SALT ELECTROLYSIS

Figure 1:
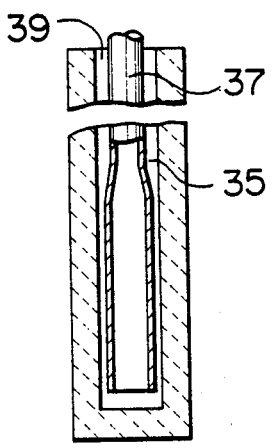

The present invention relates to an apparatus for electrolytic production of such metal as magnesium and chlorine gas from molten salt and, in particular, such apparatus improved in heat removability from especially the lead block to the cathode, so as to allow an operation at an increased voltage over a series of electrodes with bipolar intermediate electrodes arranged between the anode and cathode.

Electrolytic production of such metal as magnesium is often conducted on commercial scale, for example, in a cell comprising a set or sets of anode and cathode without (parallel type) or with intermediate bipolar electrodes between the anode and cathode (serial type), whereby a fused salt comprising $MgCl_2$ and held therein is electrolyzed into the metal and chlorine.

Relative to the parallel type of a comparable production capacity with a corresponding number of electrodes, the serial type is preferable for such advantages that the cell can be built into a compact and simplified construction due to the intermediate electrodes being essentially free from external wiring for leading power and that an improved power economy is achievable as a result of the less employment of a lead material, usually of carbon steel or graphite, which not only carries away some heat wastefully from inside to outside the cell, but also causes a voltage drop therein.

For the serial type to achieve a productivity as high as the plant area, given to the cell, can produce, it is essential that as many electrodes be contained and utilized as the cell space allows. As the set of electrodes requires an increasingly high overall voltage with the number of the intermediate electrodes employed and, thus, tend more and more to suffer from a current leakage through the electrolyte bath, so the total number of the electrodes heretofore available is practically limited to less than 10. A greater number of electrodes can be arranged, in a single cell, only in sets, with anode and cathode in each, resulting in that one or more electrodes are inevitably located far off from the outside wall, inwards the electrolysis chamber. As imposed of a high voltage, it may be unfavorable that the lead to an inward located electrode be arranged laterally, even if well insulated conventionally, over a longer distance through the chamber which is provided next to the electrolysis chamber and loaded of the conductive bath. Rather the lead may be better constructed by extending vertically through the top cover for minimizing the portion in the conductive bath and, thus, eventual current leakage therethrough to another electrode of opposite polarity. As made of an iron material which is less resistant, at elevated temperatures, to attack by chlorine than the graphite for the anode, the lead to a cathode, when placed amid the electrolysis chamber, requires a special means or device in order to achieve a reasonable service life, by keeping the lead either out of contact with chlorine or at such low temperature that the corrosion proceeds only at a very limited rate, for example. With the former being practically impossible to realize, the latter principally has been taken, wherein the lead is covered with a layer of insulative bricks, which unfavorably requires such large thickness as to remarkably deteriorate the area efficiency of the plant relative to the production capacity.

Therefore one of the principal objects of the present invention is to provide a solution to the above described problem, wherein the lead to the cathode located especially amid an electrolysis chamber of serial arrangement is properly coolable with a specific forcible cooling means.

According to the invention there is provided a cell comprising: an electrolysis chamber which is capable of holding a molten salt of metallic chloride and is closed upwards with a top cover, a cathode placed in said chamber, a lead block of metallic material which runs through the top cover and comprises therealong a bottom-closed axial cavity with inlet and outlet for a fluid coolant connected thereto, said cathode and lead block connected to each other below the bath level to be employed of said salt, and said cavity reaching below said level.

In the invention the cavity, for example, can be one or more bottom-closed axial bore of cylindrical or otherwise shaped cross section, formed midway in the thickness and extending vertically along the lead which is axial and blocky. A thinner tube may be arranged to extend inside and along it to below the bath level for securing the course of a coolant of dry air, water suspended air, or a continuous water to the hottest portion of the cavity. The upper end of the lead cavity may be free open for gas discharge or, alternatively, open in part with an outlet for unloading water. In another instance a thin tube is inserted to a depth above the bath level, through which a water coolant is supplied in drops, the coolant as evaporated being exhausted an outlet provided atop the cavity.

The above said techniques may be employed either singly or in combination as needed for cooling the lead to the desired level of temperature.

Argon gas also can be used as coolant in a closed circuit cooling system.

A higher efficiency in heat exchange is achievable with a gaseous coolant when the cavity is so constructed to have a decreased gap at least in part below the bath level around the inner tube in the cavity to a degree that a turbulent stream of coolant is caused.

When a cathode lead is constructed according to the invention and cooled to a temperature of or less than 200° C. approximately, the cathode lead will exhibit a substantially increased service life as effectively improved in resistance to the atmosphere comprising chlorine. Additionally, an increased production capacity can be also obtained by using a larger power input now available due to the improved heat removability.

Now the invention will be described more in particularity in the following description taken in connection with the drawing which is given merely by way of example and not limiting the invention.

Figure 2:
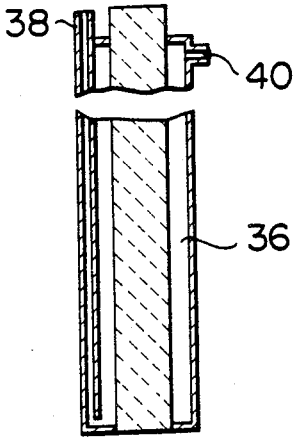

FIGS. 1 and 2 schematically show, each a sectional elevation as viewed in parallel with the thickness of cathode leads realized according to the invention.

Figure 3:
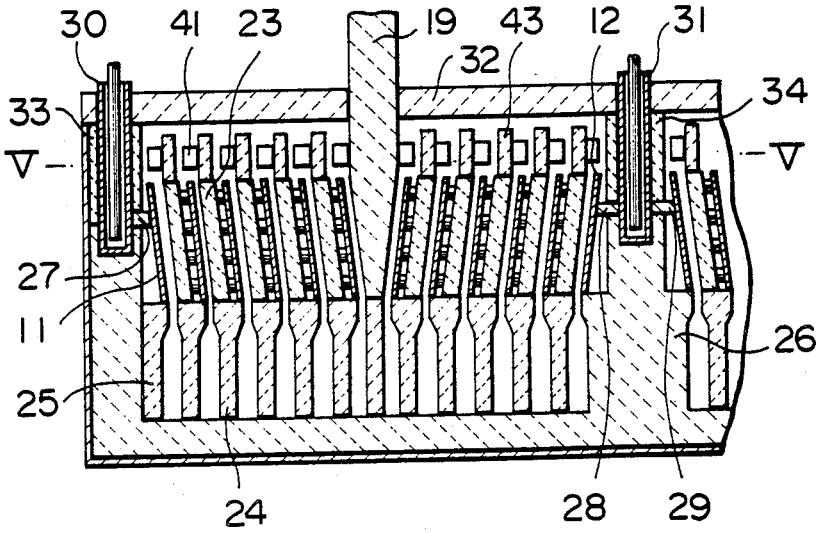
Figure 4:
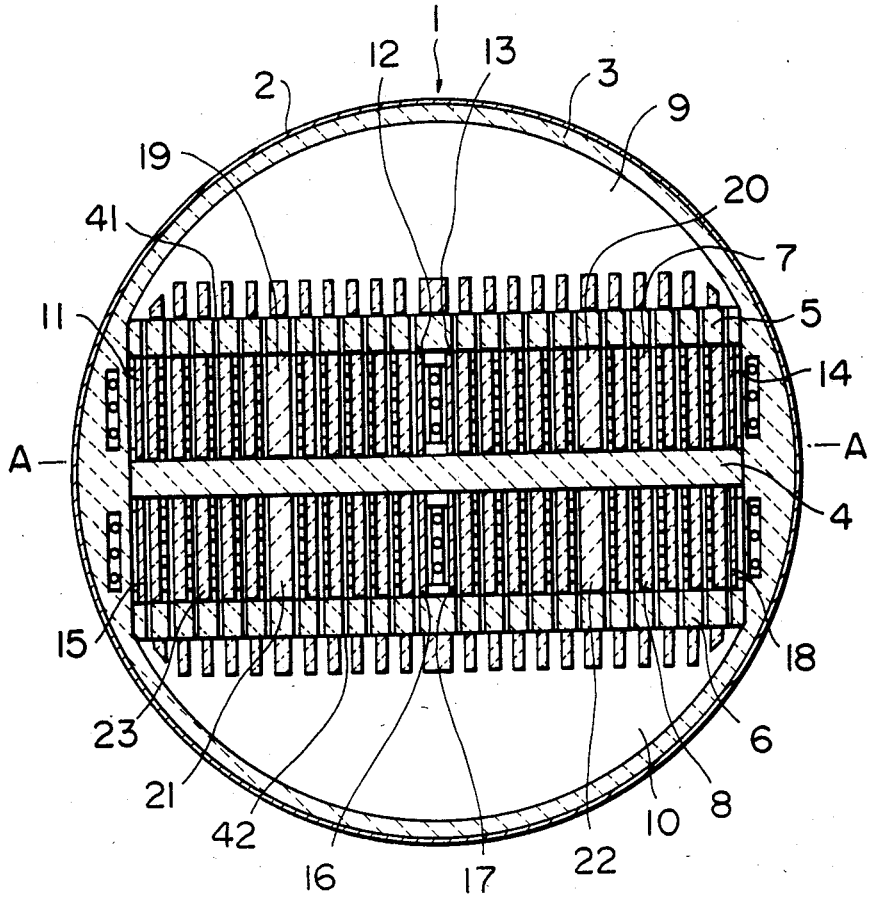

FIG. 3 shows in part a sectional elevation as viewed in parallel with the length of an electrolysis cell with such leads, and FIG. 4 is a horizontal section at a height level close to the bath level, FIG. 3 being taken along A—A on FIG. 4.

In the figures and, especially, FIG. 4 the cell generally designated at 1 comprises a steel shell 2 lined with a refractory layer of alumina bricks 3. The space defined by the layer 3 is subdivided by parallel partitions 4–6 into two electrolysis chambers 7, 8 arranged sideby-side, and metal collecting chambers 9, 10 in adjacency with said chambers 7, 8. Cathodes of iron plate 11–14 or 15–18 are seated at the ends and center of each electrolysis chamber, one at each end and two in back-to-back arrangement at each center in this illustrated example. Anodes of graphite slab 19–22 are located half-way between every two cathodes in opposition. Between the anode 19 and cathode 11, as well as the other anodes and cathodes, are arranged in series several intermediate electrodes typically designated at 23, which comprises, for example, a graphite slab and an iron plate joined to each other with iron bolts. Electrodes of each kind are seated on stands, typically designated at 24. As apparent from FIG. 3 especially, cathodes 11, 12 are seated on stands 25, 26 of refractory material and are joined on the back to lead blocks 30, 31 with the members 27, 28 and 29, respectively. The leads of carbon steel or, preferably, such coated with nickel, for example, are supported by the bottom in the refractory blocks 3 or the seat 26 and extends upwards through a top cover 32, with the intermediate portion covered with a layer of insulative material 33, 34. The lead block is provided amid the thickness with one or more bores 35 as shown in FIG. 1 and FIG. 3, the number varying dependently on the breadth and the designed power input. The cross section of the bore may vary to a degree, being rounded, rectangular, square etc, each with an inlet tube 37 or more extending along the bore and open high off or close to the bottom thereof, according to the nature of the coolant. Alternatively, a jacket 36 can be arranged around the core block of the lead, as in FIG. 2, and water coolant is allowed to pass therethrough, with inlet 38 and outlet 40 provided at the lower and upper ends, respectively.

Such cooling means may be saved as for chamber-end cathodes, if the lead is arranged close enough to the refractory lining 3 and outside shell.

The magnesium metal forming in the electrolysis chamber 2 is transferred as carried in the bath and collects through holes 41, 42 in the partitions 5, 6 at a level close to the bath surface, into the metal collecting chamber. As substantially removed of product metal, the bath comes back to the electrolysis chambers through some openings (not shown) provided downwards in the partitions.

For suppressing current leakage through the molten salt bath with the product metal afloat or in suspension, intermediate electrodes, each, may be preferably provided thereover with an elongated block of insulative material, which is laid atop and rises somewhat above the bath level V—V.

EXAMPLE

An apparatus basically illustrated in FIG. 4 was employed, which measured 8 m in O.D. and 3 m in height. The electrolysis chambers, 1.3 m wide each, contained as a whole eight sets of electrodes, each comprising an anode, a cathode and five intermediate electrodes. The two cathodes located at the center of each chamber were connected to a lead of iron block which had a horizontal cross section 20×100 cm wide, and 6 bottom-closed vertical cylindrical bore of 100 mm I.D., each inserted with a tube of 86 mm diameter with the bottom end open 75 cm below the bath level. The leads were covered with an insulative over a portion just below the top cover to the lower end. The leads at the chamber ends were solid without such cooling device. The inter-electrode spacing measured 4 cm and 5 cm at the lower and upper ends, respectively.

The cell was charged with a molten salt comprising NaCl, $MgCl_2$ and $CaCl_2$, applied with a tension of 24.5 volts over each set of electrodes, and operated at a bath temperature around 680° C. The two leads at the chamber center was cooled to some 60° C. as on the tube wall by passing a forced flow of air at 35 m/sec., thus an input of 55 KVA was available for a continuous operation.

For the purpose of comparison, such apparatus was operated without actuating the cooling means on the cathode leads. A maximum power input of 52 KVA was available, with the temperature on the tube walls reaching levels around 550° C., too high to increase the input, due to the inefficient heat removal.

I claim:

1. An apparatus for molten salt electrolysis, comprising: an electrolysis chamber which is capable of holding a body of molten metallic chloride salt, said chamber being closed with a top cover; a cathode in said chamber; an elongate lead block of metallic material extending through said top cover and comprising a cavity extending axially therein, said cavity being closed at its bottom and having an inlet and an outlet for flow of a fluid coolant through said cavity; said cathode and lead block being connected to each other below the surface of said body of molten salt; and said cavity extending through the top cover and reaching below the surface of said body of molten salt.

2. Apparatus as claimed in claim 1, in which said cavity comprises a vertical bore located amid the thickness of said lead block, and wherein said apparatus further comprises a tube inserted axially in said bore with a gap therearound, said tube extending downwardly to a depth close to the bottom of the bore.

3. Apparatus as claimed in claim 1, in which said cavity comprises a jacket arranged over a core body of said lead block, said cavity having an inlet and outlet for flow of fluid coolant through said jacket.

4. Apparatus as claimed in claim 1, in which said coolant comprises at least one member selected from the group consisting of water and air.

5. Apparatus as claimed in claim 1, in which said inlet for the coolant comprises a tube inserted in said cavity for drip-feeding water coolant.

* * * * *